US006365811B1

(12) United States Patent
Conta

(10) Patent No.: US 6,365,811 B1
(45) Date of Patent: Apr. 2, 2002

(54) DRUM HEAD ATTACHMENT AND TUNING ASSEMBLY

(76) Inventor: Sean B. Conta, 3650 92nd Ave., SE., Mercer Island, WA (US) 98040

( * ) Notice: Subject to any disclaimer, the term of this patent is extended or adjusted under 35 U.S.C. 154(b) by 0 days.

(21) Appl. No.: 09/588,404

(22) Filed: Jun. 6, 2000

(51) Int. Cl.[7] ..... G10D 13/02
(52) U.S. Cl. ..... 84/411 R; 84/411 A; 84/413
(58) Field of Search ..... 84/411 R, 411 A, 84/413

(56) References Cited

U.S. PATENT DOCUMENTS

| | | | | |
|---|---|---|---|---|
| 583,372 A | * | 5/1897 | Henderson | |
| 1,901,765 A | * | 3/1933 | Newberry | |
| 4,079,657 A | | 3/1978 | Sobreira | 84/411 R |
| 4,188,852 A | | 2/1980 | Light | 84/411 A |
| 4,218,952 A | | 8/1980 | Arbiter | 84/411 A |
| 4,909,125 A | | 3/1990 | Fece | 84/411 A |
| 5,392,681 A | | 2/1995 | Hall | 84/413 |
| 5,739,448 A | | 4/1998 | Toscano | 84/413 |

FOREIGN PATENT DOCUMENTS

| | | | |
|---|---|---|---|
| BE | 495566 | * | 9/1950 |

* cited by examiner

*Primary Examiner*—Shih-yung Hsieh
(74) *Attorney, Agent, or Firm*—Klauber & Jackson

(57) ABSTRACT

A drum head attachment for use with a drum where the mechanism allows the user to individually tighten the normal lug bolts to tighten the drum head at discrete localized areas or to use the present mechanism to tighten or loosen the entire drum head over the total area as a absolute change. In carrying out the present invention, use is made of the plurality of standard lug bolts that can be individually tightened as is conventional, however, those lug bolts are each affixed to a lug block that is movable by the user axially with respect to the central longitudinal axis of the cylindrical drum shell. By the present mechanism, all of the lug blocks can be thus moved axially simultaneously so as to tighten or loosen the entire drum head. The lug blocks are constrained to movement along the axis of the cylindrical drum shell so that no twisting occurs to the drum head and the tension is thus adjusted as desired in a uniform manner.

10 Claims, 2 Drawing Sheets

DRUM HEAD ATTACHMENT AND TUNING ASSEMBLY

FIELD OF THE INVENTION

The present invention relates generally to percussion instruments, and, more particularly, to a drum having a drum shell and a drum head affixed in tension to an open end of the drum shell, and having a means to adjust the tension of the drum heat in discrete areas about the periphery of the drum head and/or to adjust the tension fully across the entire area of the drum head.

BACKGROUND OF THE INVENTION

With a musical percussion instrument such as a drum, a beat or rhythm is created by beating or striking the drum head to establish a vibration that is resonated throughout a drum shell, generally cylindrical in shape, and the percussion instrument produces a particular note of a desired pitch level. That particular pitch is determined basically by the tension in the drum head that is stretched across the open end of the drum shell. While the drum head is stretched in tension, various conditions as well as the normal use of the instrument can affect the tension and thus, it is quite common that there is a need to adjust the tension from time to time to bring the pitch back to the desired note.

There are a number of differing methods and systems for adjusting the tension of a drum head, however, the most common is through the use of a hoop that is used to affix the drum head to the open end of the drum shell. The hoop is a cylindrical ring that encircles the periphery of the drum head and not only affixes the drum head to the drum shell but is arranged such that the drum hoop can be adjusted to draw the drum head tighter or looser across the open end to adjust the tension on the drum head and, thus, adjust the pitch of the sound from the drum. Again, in the typical manner, there are a plurality of tensioning rods that are affixed to the drum hoop and to the drum shell, or another oppositely disposed drum hoop, and there is an adjusting mechanism that allows the tensioning rods to draw the drum head tighter or looser to affect its tension. Normally, the means to affect the tension is through the use of a number of threaded lug bolts that can be rotated so as to adjust the axial position of the drum hoop to pull the drum head tighter or looser against the drum shell. Generally, there may be from four to twelve or more lug bolts that can be adjusted depending upon the particular drum.

One of the difficulties in the tuning of a drum is to make the adjustment of the tension even or uniform throughout the drum head, that is, the user must adjust each individual bolt to create the overall to be head is tuned to itself to cause the overall tension to be uniform. With the aforedescribed system, therefore, to tune the overall drum head to itself, it is necessary to tune individual lug bolts all around the periphery of the drum head so that the overall tension across the drum head can be exactly the same, a feat that is not particularly easy to accomplish. Aside from that tuning, the overall proper tension across the drum head itself, or the absolute tension, must also be adjusted and in such case, again, all of the individual lug bolts must be adjusted, in this case, such that each must be tightened or loosened the exact same amount so that the overall tension is adjusted uniformly. Not only is it quite difficult to tune each lug bolt the exact amount, it is very difficult to play the drum as the tuning is taking place to hear the effect that the re-tensioning is having on the sound of the drum. The tuning is made even more difficult where there is a two headed drum that requires tuning of both the top and bottom heads simultaneously.

As indicated, the threaded lug bolts are provided as a plurality of such bolts and are spaced radially around the outer periphery of the drum head so that the overall tightening process requires the user to tighten each threaded bolt individually to change the tension in the overall drum head. As such, the process is somewhat limited in its ability to accurately tighten each of the individual bolts to achieve uniformity or, on the other hand, the process takes considerable time to achieve the desired drum sound. As will be seen, however, there is an advantage in having the ability to adjust the drum tension in a plurality of discrete areas around the periphery of the drum, however, it would also be an advantage to have a simpler method and mechanism for causing an overall adjustment to the tension of the drum head without going through the laborious task of individually adjusting a plurality of bolts circling the periphery of the drum head. Thus, in effect, it would be advantageous to be able to make the individual adjustments at localized discrete areas of the drum head as is conventional while having a more simple means of adjusting the overall absolute head tension.

There has evolved, various systems to carry out the overall adjustment of the drum head. For example, in the Toscano U.S. Pat. No. 5,739,448, there is a mechanism that can be used to tighten the entire drum head as a whole, that is, by rotating a key, a counter hoop is caused to rotate and move axially with respect to the drum shell to adjust the tension across the entire drum head. While the mechanism is adaptable to adjust the overall drum head tension, the counterhoop rotates so as to create difficulty in obtaining a uniform tension as there can be some twisting of the peripheral edge of the drum head. Additionally, the mechanism of Toscani has no means to allow the user to change the tension at lesser, discrete areas of the drum head as is possible with conventional drum head tensioning mechanisms using the tensioning rods and threaded bolts. The ability to rely on the well known, conventional individual tensioning rods and threaded bolts is an advantageous feature to users that are well familiar with and thus comfortable with such means.

On the other hand, in the Light U.S. Pat. No. 4,188,852 there is a mechanism that can be used to adjust the overall tension of the drum while at the same time, use a manual adjustment nut to adjust the drum tension at smaller, discrete areas. However in the Light reference, there is the use of multiple sprockets and a chain and would be a cumbersome mechanism to operate and install and requires very close tolerances to maintain uniformity along the periphery of the drum head as the tension of the overall drum head is adjusted. With Light, the individual tightening nuts are in an unconventional location and are difficult to utilize. It would be preferable to have a mechanism that would utilize the normal tensioning lug bolts surrounding the outer periphery adjacent the drum head to carry out the localized area adjustments to the drum head as the user is well familiar with tightening those individual bolts manually at the outer periphery of the drum head.

Other examples of mechanisms that can be used to carry out an overall tightening of the drum head include that disclosed in U.S. Pat. No. 4,079,657 of Sobriera where a ratchet type arrangement is proposed and U.S. Pat. No. 4,218,952 of Arbiter where there is a camming means employed, however, each reference has certain drawbacks in adjustability of the tension or in the complexity of the mechanism involved.

Accordingly, it would be advantageous to have a drum tensioning system and mechanism that would allow the user an easy means to adjust the overall tension in the drum head as well as to allow the conventional adjustment by means of individual devices to tune the drum head in discrete areas around the periphery of the drum head.

SUMMARY OF THE INVENTION

Therefore, in accordance with the present invention, there is a drum tuning mechanism that utilizes some of the conventional lug bolts so that the user can individually carry out the normal tuning as is presently accomplished but where a further improvement is included to facilitate the tuning of the overall absolute head tension. Accordingly, with the present mechanism, there is a drum shell that is a normal cylindrical configuration having a central axis and which has a drum head tautly covering at least one of the ends of the drum shell.

Surrounding the periphery of the drum head is a drum hoop, again generally in accordance with conventional construction and which affixes the normal mylar drum head to the end of the drum shell. As is conventional, the drum hoop is adapted to move axially with respect to the central axis of the cylindrical drum shell so as to allow the tightening and loosening of the tension on the drum head.

The present invention also includes a plurality of lug bolts that are spaced about the periphery of the drum head and which can be used to tighten and loosen the tension on the drum head in discrete areas about that drum head much in the manner that such drum heads are currently adjusted for tension. With the present invention, however, the lug bolts include shoulders that bear downwardly against the areas of the drum hoop and which can be hand tightened by a conventional drum tightening drum key to effect the normal tightening of the drum head by localized areas, however, the other ends of each of the lug bolts are threadedly secured to lug blocks that are axially movable with respect to the same central axis of the cylindrical drum shell. Thus, there are a plurality of the lug blocks that are located around the outer surface of the drum shell and which are constrained for movement only in that axial direction.

Normally, the lug blocks are secured positively so as to allow the user to make an individual tightening or loosening of any of the lug bolts, however, in addition, the lug bolts are all moveable simultaneously so as to increase or decrease the absolute tension universally of the drum head. In the preferred embodiment, there is a annular outer ring that surrounds the entire outside of the drum shell and which is movably threaded to an inner ring that is firmly affixed to the drum shell. By thus rotating the outer ring, the threaded engagement with the inner ring causes the outer ring to move axially with respect to the central axis of the drum shell. The lug blocks are therefore all affixed to the outer ring with a sliding fit such that as the outer ring is displaced axially, so are the plurality of lug bolts and correspondingly, the entire drum hoop is caused to also move axially to change the overall absolute tension of the drum head.

Accordingly, the present drum tuning mechanism allows the user to carry out the conventional individual adjustment of a plurality of lug bolts to adjust the drum head tension at a plurality of discrete localized areas around that drum head, or alternately, to cause a rotation of the outer ring to move all of the lug bolts simultaneously to affect the overall tension of the drum head.

Other features and advantages will become apparent to those skilled in the art from a review of the ensuing description which proceeds with reference to the following illustrative drawings.

DETAILED DESCRIPTION

Figure 1:
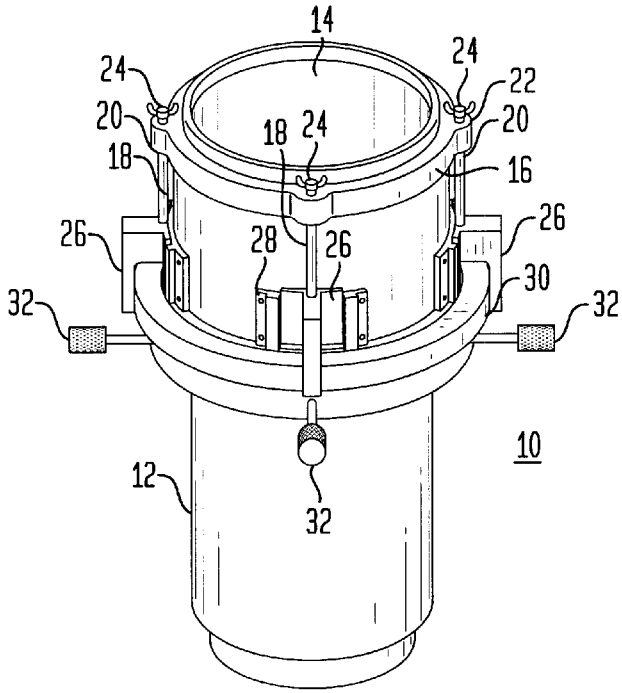
FIG. 1 is a perspective view of a drum having the mechanism of the present invention affixed thereto.

Turning now to FIG. 1, there is shown a perspective view of a drum 10 having a drum tuning mechanism constructed in accordance with the present invention. As can be seen, the drum 10 has a drum shell 12 that is, as is normal, cylindrical, in shape and which has a central longitudinal cylindrical axis. At the top, open end of the cylindrical drum shell 12, there is a drum head 14 that is affixed thereto across that open end so as to be in tension. Typically, the drum head 14 is comprised of mylar or other material suitable for such use. The actual means of affixing the drum head 14 to the open end of the cylindrical drum shell 12 will be later explained.

Positioned at the open end of the drum shell 12 is a drum hoop 16 and which is a circular metal hoop that encircles the outside perimeter of the open end of the drum shell 12 and retains the drum head 14 in position atop of the drum shell 12 with the proper tension to produce the desired sound. As will be seen, by drawing the drum hoop 16 closer to the drum shell 12, the tension in the drum head 14 can be increased along with raising the pitch of the tone produced by the drum. The converse is, of course, also true if the drum head 14 tension were lessened.

Accordingly, the drum hoop 16 is affixed to the drum 10 by means of plurality of lug bolts 18 that are threaded and have upper ends 20 which pass through an outwardly extending flange 22 formed in the drum hoop 16. Thus, the upper ends 20 of the lug bolts 18 pass through the drum hoop 16 and have shoulders that engage the upper surface of the drum hoop 16 as conventional. There is formed at the top of the lug bolts, square male fittings 24 that can be engaged by the normal drum key used by the drummer to rotate the lug bolts 18 to alter the axial position of the drum hoop 16 as will become clear.

The lower ends of the lug bolts 18 are affixed in a plurality of equal number of lug blocks 26 that ride along the exterior of the drum shell 12 on lug block guides 28. The lug block guides 28 are firmly affixed to that exterior of the drum shell 12 and constrain the movement of the lug blocks 26 to axial movement with respect to the central, longitudinal axis of the cylindrical drum shell 12. That is, in the Fig., lug blocks 26 can only move upwardly and downwardly along the exterior of the drum shell 12 and cannot move in a circular arc around the exterior surface of that drum shell 12.

As can also be seen in FIG. 1, there is an outer ring 30 that surrounds the exterior of the drum shell 12 and can be rotated by the user about that exterior surface. To aid in the rotation of the outer ring 30, there may be a plurality of handles 32 that extend outwardly from the outer ring 30 to allow the user to grasp the handles 32 and thus use that additional leverage and ease to grip and rotate the outer ring 30.

Figure 2:
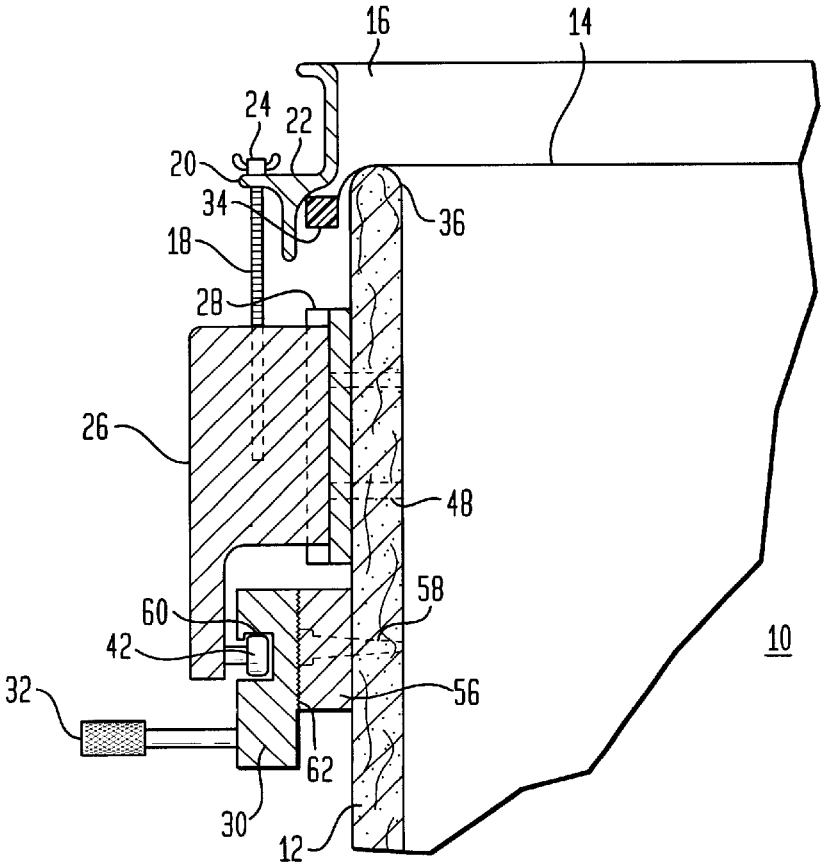
FIG. 2 is a cutaway side sectional view of the mechanism of the present invention on the drum of FIG. 1.

Turning now to FIG. 2, there is shown a cut away side view, partially in section, of the drum tuning mechanism of the present invention. Thus, in FIG. 2, there can be seen the drum head 14 that stretches across the open end of drum shell 12 and that drum head 14 has a outer peripheral bead 34 that passes over the upper circular edge 36 of the drum shell 12 and the bead 34 is pulled downwardly by the drum loop 16. Accordingly, as can be seen, as the drum loop 16 is pulled downwardly, the tension in the drum head 14 is increased and, conversely, as the drum hoop 16 is elevated, the tension in the drum head 14 is lessened. That changing tension, obviously, affects the pitch of the tone emanated by the drum 10 when struck.

Figure 3:
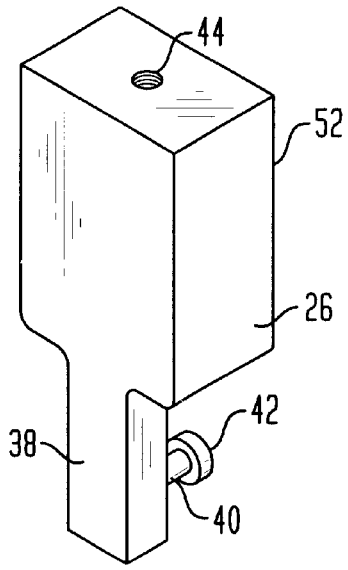
FIG. 3 is a perspective view of a lug block employed with the present invention.
Figure 4:
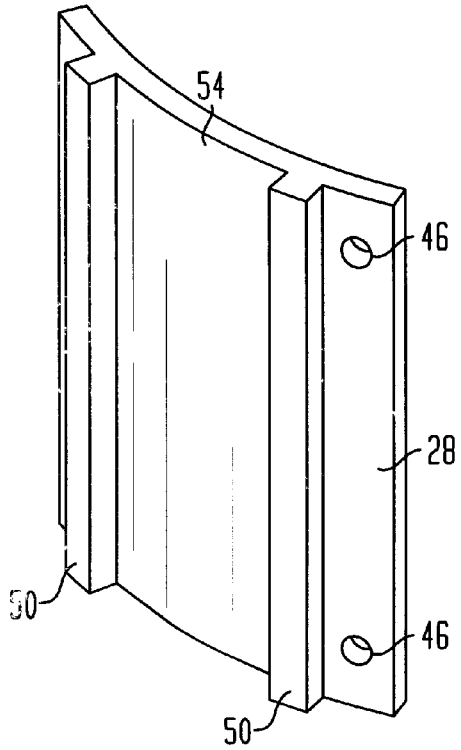
FIG. 4 is a perspective view of a lug block guide used with the present invention.

Turning briefly to FIGS. 3 and 4, in connection with FIG. 2, there are shown perspective views of a lug block 26 and a lug block guide 28, respectively, such that the lug block 26 has a downwardly extending arm 38 having at or near the lower extremity thereof, an inwardly directed axle 40 having a roller 42 at the external end thereof. In addition, as also can be seen in FIG. 3, the upper surface of the lug block 26 has a bore 44 that may be threaded so that a lug bolt 18 can be screwed into the bore 44 to secure that lug bolt 18 to the lug block 26.

In FIG. 4, there can be seen a curved lug block guide 28 that has a number of holes 46 as one means of carrying out the affixation of the lug block guide 28 to the exterior of the drum shell 12. Screws 48 can be used to pass through the holes 46 to carry out one of such means, however, there may be a number of ways to solidly affix the lug block guides 28 to the drum shell. There are two guide flanges 50 that act against the exterior sides of the lug block 26 when those components are assembled together with the inner surface 52 of the lug block 26 riding along the outer surface 54 of the lug block guide 28 so that such lug block 26 is free to move along the lug block guide 28 only in the direction of the central longitudinal axis of the drum shell 12 and the movement of the lug block 26 is constrained from movement in any other direction.

Thus returning now to FIG. 2, there is also an inner ring 56 that is affixed to the drum shell 12 and again, may be affixed thereto by screws 58. As can also be seen, the roller 42 fits within an annular recess 60 formed in the outer ring 30 and is held captive therein. The inner surface of the outer ring 30 and the outer surface of the inner ring 56 are mating threaded surfaces shown at 62. Accordingly, since the inner ring 56 is firmly affixed to the drum shell 12 and does not move, the outer ring 30 is free to rotate about the drum shell 12 by means of the user manipulating the handle 32 or handles 32. As such, due to the mating threaded surfaces, at 62, as the outer ring 30 is rotated, the screw threads cause the outer ring 30 to move axially upwardly or downwardly with respect to the central longitudinal axis of the cylindrical drum shell 12. As can be understood, the pitch of the threaded interconnection between the outer ring 30 and the inner ring 56 is a shallow pitch such that very minute axial or vertical movement is caused by a revolution of the outer ring.

As can now be appreciated, as the outer ring 30 moves axially parallel to the main axis of the cylindrical drum shell 12, the axial movement is translated by means of the roller 42 captured in the annular recess 60 to also move the lug blocks 26 and thus the drum loop 16 to tighten or loosen the overall tension across the entire drum head 14.

As such, therefore, as the user desires to tighten the drum head 14 by discrete areas as is presently done, the individual lug bolts 18 can be rotated by means of a conventional drum key to carry out the localized tightening in the normal manner with which the user is no doubt familiar. If, however, the user desires to make an absolute alteration of the tension of the entire drum head 14, the user can simply grasp the handles 32 and rotate the outer ring 30 so that all of the lug blocks are simultaneously axially moved with respect to the central longitudinal axis of the drum shell 12 to carry out an overall tightening or loosening of the drum head 14. Accordingly, the present drum tuning mechanism can be used without departing from the conventional tightening of individual lug bolts that the user is well familiar, or the mechanism allows the user to employ the present mechanism to totally and uniformly change the tension on the overall drum head 14.

As an alternative embodiment, the lug bolts 26 can be axially moved by other means and still be within the concept of the present invention. For example, there may be only a single ring that is axially fixed with respect to the drum shell but is rotatably affixed thereto. At the inner surface of the single ring, or a flange formed as a part thereof, there may be formed the shallow pitch threads as described and which may mate with threads formed on the exterior surface of the lug blocks so that the same basic invention is carried out, that is, the lug bolts can be individually adjusted to tune the drum head against itself while having a single action that can cause all of the lug bolts to move axially simultaneously by a rotating ring.

Those skilled in the art will recognize numerous adaptations and modifications which can be made to the drum tuning mechanism of the present invention which will result in an improved apparatus, yet all of which will fall within the scope and spirit of the present invention as defined in the following claims. Accordingly, the invention is to be limited only by the following claims and their equivalents.

I claim:

1. A drum assembly comprising:

a cylindrical drum shell having a central axis and having a drum head extending under tension over an open end of said cylindrical drum shell;

a drum hoop affixed to said drum shell and surrounding the outer periphery of said drum head to affix said drum head to said open end of said cylindrical drum shell, said drum hoop adapted to be moved axially with respect to said drum shell to adjust the tension in said drum head, a plurality of lug blocks affixed to said drum shell and constrained for axial movement with respect to said drum shell;

a plurality of individual tightening means affixed to said drum hoop and spaced about the periphery of said drum head, each of said individual tightening means adapted to be affixed to one of said plurality of lug blocks, said individual tightening means adapted to move said drum hoop to adjust the tension in said drum head in discrete areas across said open end of said drum shell; and means to move all of said lug blocks simultaneously to move said drum hoop axially with respect to said drum shell to adjust the overall tension across the entire drum head;

wherein said drum assembly includes drum block guides affixed to said drum shell and where said lug blocks are sliding engaged within said lug block guides.

2. A drum assembly as defined in claim 1 wherein said individual tightening means comprise threaded lug bolts having shoulders that engage said drum hoop and threadedly engaged with said lug block.

3. A drum assembly as defined in claim 1 wherein said lug block guides have elongated recesses into which said lug blocks are interfitted.

4. A drum assembly as defined in claim 1 wherein said means to move all of said lug blocks simultaneously comprises an inner ring affixed to said drum shell and an outer ring threadedly affixed to said inner ring, said outer ring being rotatable to cause said outer ring to move axially with respect to said drum shell, and said lug blocks are in contact with said outer ring and move axially with said outer ring.

5. A drum assembly as defined in claim 4, where said outer ring has an outer annular recess and said lug blocks include rollers adapted to be interfitted into and retained within said annular recess.

6. A drum tuning assembly adapted to be affixed to a cylindrical drum having a central axis and a drum head affixed to an open end of said cylindrical drum shell, said assembly comprising:

a drum hoop adapted to be affixed to the drum shell to surround the outer periphery of the drum head to affix the drum head to the open end of the cylindrical drum shell, said drum hoop adapted to be moved axially with respect to the drum shell to adjust the tension in the drum head, a plurality of lug blocks slidingly affixed to the drum shell and constrained for axial movement with respect to the drum shell;

a plurality of individual tightening means affixed to said drum hoop and spaced about the periphery of the drum head, each of said individual tightening means adapted to be adjustably affixed to one of said plurality of lug blocks to move said drum hoop to adjust the tension in the drum head in discrete areas across said open end of the drum shell; and means to move all of said lug blocks simultaneously to move said drum hoop axially with respect to the drum shell to adjust the overall tension across the entire drum head;

wherein said means to move said lug blocks in an axial direction includes a lug block guide adapted to receive each of said lug blocks to constrain movement of said lug blocks to only the axial direction.

7. A drum tuning assembly as defined in claim 6 wherein said individual tightening means comprise threaded lug bolts having shoulders that engage said drum hoop and threadedly engaged with said lug block.

8. A drum assembly comprising:

a cylindrical drum shell having a central axis and having a drum head extending under tension over an open end of said cylindrical drum shell;

a drum hoop affixed to said drum shell and surrounding the outer periphery of said drum head to affix said drum head to said open end of said cylindrical drum shell, said drum hoop adapted to be moved axially with respect to said drum shell to adjust the tension in said drum head, a plurality of lug blocks affixed to said drum shell and constrained for axial movement with respect to said drum shell;

a plurality of lug bolts extending between said lug blocks and said drum hoop, said lug bolts allowing said drum hoop to be moved in discrete areas about said drum head to adjust the tension on said drum head at such areas, and means to move all of said lug blocks simultaneously in an axial direction with respect to said central axis to adjust the absolute tension across the overall drum head;

wherein said means to move said lug blocks in an axial direction includes a lug block guide adapted to receive each of said lug blocks to constrain movement of said lug blocks to only the axial direction.

9. A drum assembly as defined in claim 8 wherein said means to move all of said lug blocks comprises a fixed inner ring affixed to said drum shell and a rotatable outer ring encircling said inner ring and threadedly engaged therewith, said outer ring being rotatable with respect to said inner ring to move said outer ring in the axial direction with respect to the central axis of said cylindrical drum shell, and where said lug blocks are slidably affixed to said outer ring.

10. A drum assembly as defined in claim 9 wherein said outer ring has an annular recess and said lug blocks have rollers the interfit into said annular recess to affix said lug blocks to said outer ring.

* * * * *